United States Patent [19]

Hayfield

[11] 4,039,400

[45] Aug. 2, 1977

[54] METHOD OF FORMING ELECTRODES

[75] Inventor: Peter Charles Steele Hayfield, Bickenhill, England

[73] Assignee: Marston Excelsior Limited, Staffordshire, United Kingdom

[21] Appl. No.: 627,007

[22] Filed: Oct. 29, 1975

[30] Foreign Application Priority Data

Oct. 29, 1974 United Kingdom ..... 46710/74
Feb. 14, 1975 United Kingdom ..... 6393/75

[51] Int. Cl.[2] ..... C25D 5/00; C25B 11/08; C25B 11/10

[52] U.S. Cl. ..... 204/38 R; 204/38 A; 204/38 B; 204/38 C; 204/38 S; 204/290 F; 204/96

[58] Field of Search ..... 204/38 C, 38 R, 38 A, 204/38 S, 38 B, 290 F, 96

[56] References Cited

U.S. PATENT DOCUMENTS 3,869,312 3/1975 Moss et al. ..... 204/290 F

FOREIGN PATENT DOCUMENTS 1,327,760 8/1973 United Kingdom

*Primary Examiner*—R. L. Andrews
*Attorney, Agent, or Firm*—Cushman, Darby & Cushman

[57] ABSTRACT

A method of manufacturing an electrode which comprises depositing an oxide of titanium from a solution onto a surface of a film-forming metal, heating the oxide to dry it, depositing a second titanium oxide layer on the first oxide layer and then depositing an electrocatalytic layer onto the titanium oxide layers.

20 Claims, 2 Drawing Figures

METHOD OF FORMING ELECTRODES

BACKGROUND OF THE INVENTION

This invention relates to electrodes and is particularly related to electrodes which are suitable for use in electrolytic processes. Examples of such electrolytic processes are chlor-alkali electrolysis, electroplating and cathodic protection.

This invention is particularly concerned with electrodes in which at least the surface of an electrode base is formed of a "film-forming metal", there being applied to at least part of said surface an electrically conductive electrolyte-resistant and electrolysis product resistant coating. The term film-forming metal is used herein to refer to titanium and titanium base alloys, tantalum and tantalum base alloys, zirconium and zirconium base alloys, niobium and niobium base alloys, hafnium and hafnium base alloys. By "metals of the platinum group" is meant platinum, iridium, rhodium, osmium, ruthenium and palladium, and alloys thereof.

There has been proposed, see for example British Patent Specification No 925080, a method of manufacturing an electrode composed of a core of titanium and a porous coating of a metal of the platinum group. The titanium core was provided with a barrier layer by anodising or by oxidation before the coating was applied to it. The British Patent Specification refers to the advantages of such a method, stating them to be the avoidance of any necessity prior to coating with a metal of the platinum group to have to remove the oxide film naturally occurring on titanium. Further advantages are said to be the certainty that the titanium will be protected from corrosion by the barrier layer, even under the coating of a metal of the platinum group, which could be significant should said coating be damaged, the avoidance of any need to remove the barrier layer when a fresh coating of the platinum group is to be applied, and the ease in providing an adherent coating of the metal of the platinum group.

In British Patent Specification No 1327760, there is described an improved method of applying a barrier layer onto the film-forming metal. Basically, the method comprises inserting a film-forming metal surface into a solution of titanium and depositing an oxide of titanium onto the film-forming metal surface. An electrically conductive and electrolyte-resistant layer is then applied to the titanium oxide surface.

It has now been discovered that a great improvement in the method of manufacturing an electrode can be obtained by depositing more than one oxide layer from a solution and heating each oxide layer above ambient temperature to dry out the layer thoroughly before applying any further oxide layer to the surface. This change in procedure leads to a significant increase in the durability of the coating.

Without prejudice to the present invention, it is believed that heating the oxide layer above ambient temperature causes it to crack as the moisture contained in the layer is driven off. Any subsequent layers which are applied and heated also crack, but since the cracking is at random, there is a reasonable possibility that the cracks will not coincide. The effect of this is to reduce the direct path between the outer surface of the eventual electrode and the film-forming metal substrate. Clearly, if more than two layers are used, the probability of a direct path is further reduced. If the oxide layers are not dried above ambient temperature, however, the moisture is retained and the oxide layer does not produce anything more than incipient cracking. This means that any substrate oxide layer applied is effectively continuous with the first layer and when heated above ambient temperatures, both layers crack as a single unit.

SUMMARY OF THE INVENTION

By the present invention, there is provided a method of manufacturing an electrode suitable for use in electrolytic processes which comprises the steps of inserting into a solution containing cations of titanium a body having at least its surface chosen from the group of a film-forming metal, nickel or lead, connecting the body as an anode and depositing on the surface a layer of an oxide of titanium, removing the body from the solution and heating the layer to a temperature greater than 100° C, but less than 800° C, reinserting the body in a solution containing cations of titanium, connecting the body as an anode and depositing a further layer of an oxide of titanium on the surface and applying to the surface an electrically conductive electrolyte-resistant and electrolysis product resistant layer containing a metal of the platinum group or an oxide of a metal of the platinum group.

The heating preferably occurs in an oxidising atmosphere, such as air. The temperature range may be 100°–800° C. The duration of heating can be 100 hours to 1–2 minutes, preferably in the range 2 hours to 20 minutes. The temperature range may be 200°–800° or 300°–700° and is preferably 350°–550° C with 450°–500° C the normally used range. The electrically conductive layer may be provided between the layers of oxide or may be placed on top of the second oxide layer or, alternatively, may be placed initially on the surface of the film-forming metal.

There may be three or more oxide layers deposited on the surface and the electrically conductive layer may be provided between any or all pairs of oxide layers or may be applied to the outer oxide layer only or to the inner oxide layer only. The electrically conductive layer may be provided by applying a solution of a platinum group metal compound in a solvent onto the surface of the film-forming metal or onto the oxide layer, and heating the compound to form a platinum group metal or oxide. More than one layer of a platinum group metal or oxide may be applied if required. Particular examples of the electrically conductive layers are platinum-iridium alloys and ruthenium dioxide.

The electrically conductive electrolyte-resistant and electrolysis product resistant layer may conain a mixture of a platinum group metal or metals, or an oxide of a metal of the platinum group with an oxide of a film-forming metal. The layer may be applied by co-depositing a mixture of the oxide of a film-forming metal, or a compound which on heating forms an oxide of the film-forming metal, and a platinum group metal or metals or an oxide of a metal of the platinum group, or a compound which on heating forms an oxide of a platinum group metal.

The oxide of the platinum group metal may be ruthenium oxide.

There may be an outer layer of a film-forming metal oxide on the outer electrically conductive layer. The outer layer may be tantalum oxide and may be applied by coating the outer layer with a solution of a compound containing tantalum in a suitable solvent followed by heating the surface to oxidise the compound to tantalum oxide.

There may be provided a primer coating onto the starting surface of the film-forming metal; the primer coating may include particulate material such as fibrous zirconium oxide. The particulate material would normally be suspended in a solution containing a precious metal compound or a compound which produces an oxide of a film-forming metal which acts to bond the particulate material to the surface. Any of the combination of oxide layers and platinum group metal coatings may then be applied to the primer coating.

Before or after any layer applied as outlined above, there may be applied a layer comprising a dispersion of small particles of titanium dioxide having a particle size in the range 0.01 to 10 microns, the layer being heated to drive off the carrier medium for the dispersion and to leave a fine layer of the small titanium dioxide particles.

As an alternative to the titanium dioxide dispersion, other porous ceramic oxides may be used, such as zirconium oxide, niobium oxide and silica; the oxides including titanium dioxide may be in their stoichiometric or non-stoichiometric composition. Alternatively, stable mixed oxides of a range of crystal forms and compositions in both stoichiometric and non-stoichiometric forms such as spinels and garnets etc. A particular form of carrier which may be used is an acrylic copolymer.

BRIEF DESCRIPTION OF THE DRAWINGS

By way of example, embodiments of the present invention will now be described with reference to the accompanying drawings of which.

DESCRIPTION OF THE PREFERRED EMBODIMENTS

EXAMPLE 1

A titanium specimen in the form of 3mm diameter wires was degreased, and then etched in a 10wt% oxalic acid solution at 80° C for 16 hours. After washing in cold water and lightly brushing to remove superficial smut, the sample was immersed in boiling dimineralised water for one hour. When dry, the sample was inserted into a solution containing $Ti^{3+}$ ions and having 7wt% sulphuric acid. The solution was maintained at a temperature of 90° C. The sample was connected as an anode and was left in the solution until 5g/m$^2$ of porous titanium oxide was electrocoated onto it. On completion, the sample was removed and washed, then dried in air at ambient temperature. The sample was heated in air at 500° C for 30 minutes, and after cooling was reinserted in the solution to deposit a further 5g/m$^2$ of titanium oxide electrocoat. This second layer was then washed, dried and heated in air at 500° C for 30 minutes. Two further layers were similarly applied and after the final layer had been applied and cooled, ruthenium chloride based paint was painted onto the surface. The surface was dried and a further layer of ruthenium chloride based paint applied to it. This process was continued until approximately 15g/m$^2$ of ruthenium had been applied whereupon the surface was stoved in air for 2 hours to convert the ruthenium chloride to ruthenium oxide.

EXAMPLE 2

A titanium specimen of the same form of Example 1 was again etched and a layer of titanium dioxide electrocoated onto it. The specimen was then heated to 300° C for a period in the region 20 minutes to 2 hours and after cooling ruthenium chloride based paint was applied to the titanium oxide surface. Several applications of the paint were made and the sample was then stoved at a temperature in the range 350°–800° C for times of a few minutes to a few hours. After cooling, a further electrocoated layer of titanium dioxide was applied under the same conditions as Example 1 and a further layer of ruthenium chloride based paint applied. This was again stoved at temperature in the range 350°–800° C to produce an electrode.

EXAMPLE 3

A further sample of titanium in the form of 3mm diameter wires was again degreased, etched and prepared as set out in Example 1. A layer of titanium dioxide was then applied to it in the same manner as set out in Example 1. The surface was then heated as set out in Example 1 and after cooling, two further layers of titanium oxide were applied, again in the same manner as described in Example 1. This produced an electrode precursor having three coats of titanium oxide and onto this precursor there was applied ruthenium chloride in the form of a paint. The electrode was then stoved to produce ruthenium oxide.

EXAMPLE 4

Figure 2:
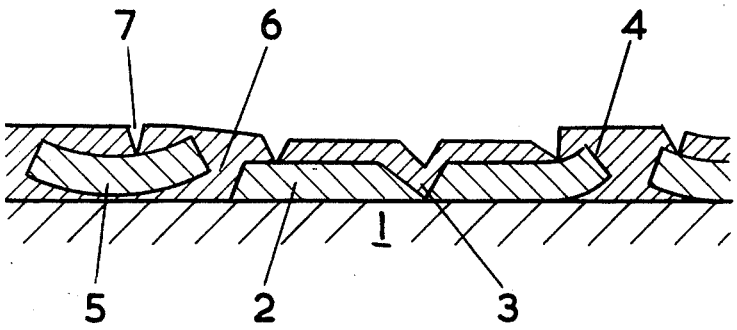
FIG. 2 is a cross-section of one form of the present invention.

A titanium specimen of the type described in Example 1 was given two electrocoats of titanium oxide with a heating stage in between, the heating taking place for a period of up to 2 hours at a temperature in the range 400°–500° C. On top of this was applied a platinum-iridium chloride in alcohol based paint and the surface was then heated to a temperature in the range 350°–550° C to convert the paint to platinum-iridium. The structure of this surface is shown schematically in FIG. 2. The titanium surface 1 has on it a first electrocoated titanium oxide layer 2 which contains cracks 3 which appear after the heating stage. It can be seen that the cracks 5 go down to the surface of the titanium. The layer 2 also tends to curl on heating as shown at 4, and some of the blocks lift completely away from the surface as at 5. The second electrocoated layer 6 fills in the cracks 3 and fills in between the curled up edges 4 and under the lifted blocks 5. When it is heated, it cracks as at 7, but the first layer tends to physically restrain the second layer from lifting and curling. This is especially so where the second layer is trapped beneath the curled up or lifted blocks, ie where most restraint is needed. The second layer cracks tend to occur where the layer is thinnest, ie over the strongest part of the first layer. The titanium surface 1 is therefore protected by the double layer from the surroundings in which the electrode is placed. The platinum-iridium which is applied goes into the pores of the porous electrocoated layers and also to some extent fills the cracks 7.

Figure 1:
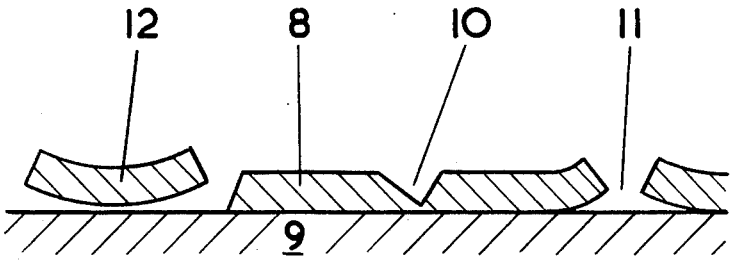
FIG. 1 is a cross-section of a prior art construction.

This type of structure can be compared with the structure shown in FIG. 1 in which the single electrocoated layer 8 on the titanium surface 9 has single large cracks 10 and curls 11 which extend from the surroundings to the surface of the titanium 9. Some blocks 12 are completely clear of the surface.

EXAMPLE 5

In a modification of Example 4, titanium wires are treated exactly as described in Example 4 but in addition there is applied a coating of a film-forming metal oxide, eg tantalum oxide. The tantalum oxide is applied in the form of a tantalum chloride containing paint which is fired in air to convert the tantalum chloride to tantalum oxide. Alternatively, a tantalate may be applied in solution form and heated to produce tantalum oxide.

EXAMPLE 6

In a modification of Example 2, the ruthenium layers were replaced with platinum-iridium layers. Otherwise the preparation route was the same as described for Example 2. In a further example, a final tantalum oxide layer was applied to the exterior of the sample by painting the sample with tantalum chloride in solution and firing in an oxygen containing atmosphere to produce tantalum oxide.

EXAMPLE 7

A titanium specimen again in the form of 3mm diameter wires was degreased and etched in 40wt% sulphuric acid at 90° C for 4 hours. After washing in cold water, the sample was then air dried. The sample was then given a primer coating comprising a platinum-iridium resinate in a solvent of butyl alcohol, together with fibrous zirconium oxide available from Imperial Chemical Industries Limited under the trade mark "Saffil". The fibrous material has an average diameter of 1–3 microns. On firing of the coating in air at a temperature of 500° C, the primer coating is converted to platinum-iridium metal (although some of the iridium may be present as an oxide) which acts to adhere the fibrous material to the surface of the titanium. Titanium oxide is then electrocoated onto the surface together with ruthenium and a further coating of titanium oxide and ruthenium exactly as described in Example 2. In alternative forms of this example, the coatings applied to the primer coating are the same as described in Examples, 1, 3, 4, 5 and 6. By this means, a homogeneous mass of substantially porous titanium oxide is formed around an inert fibrous material prior to the addition of the active coating. As an alternative to using fibrous material, the primer may contain an angular zirconium oxide particle having a size in the range of 0.01 to 5 microns.

EXAMPLE 8

A paint dispersion was manufactured by mixing an acrylic copolymer resin of the type used in conventional paints with rutile particles having a mean size of 0.2 microns. This dispersion is stable because of the small size of the rutile particles and the viscosity of the resin so that the particles do not separate out completely on standing. A titanium specimen in the form of 3mm diameter wires was taken and degreased, etched and prepared as set out in Example 1. A paint layer was then applied to the surface of the titanium of the rutile dispersion made as set out above. The sample was then dried and stoved in air at 500° C for one hour. Two coatings of titanium dioxide were applied as set out in Example 4 above with the same heat treatment between the coatings as set out in Example 4. On top of this was applied several layers of ruthenium chloride in a paint form and the sample was then stoved in air at 500° C for two hours to produce an electrode.

EXAMPLE 9

A titanium specimen in the form of 3mm diameter wires was prepared as set out in Example 4, except that the platinum-iridium layer was not applied. This sample was then coated with the rutile dispersion paint manufactured as set out above in Example 8. The rutile particles partially filled the cracks in the titanium oxide coatings but because of their particle size, did not fill the pores in the titanium oxide coatings. Ruthenium chloride was then applied in a paint form and the assembly was heated to 400° C for one hour in air to convert the ruthenium chloride to ruthenium oxide.

EXAMPLE 10

An electrode was prepared as set out in Example 9 except that the final ruthenium layer was replaced with platinum-iridium.

EXAMPLE 11

A titanium specimen was degreased, etched, washed and prepared as set out in Example 1. The sample was inserted into a 7wt% sulphuric acid solution containing 5g/l of titanium as $Ti^{3+}$ ions. The sample was supplied with a positive potential with respect to a lead cathode to give an anode current density of the order of 60 amps/m$^2$. The solution was heated to and maintained at 90° C. After 10g/m$^2$ of titanium oxide had been applied. the sample was removed, dried and heated in air to 700° C for approximately 10 minutes. A layer of rutile dispersion paint was then applied and the sample stoved for 5 minutes at 350° C. A further layer of titanium dioxide was then applied from the acidic titanium cation-containing solution and the second titanium oxide layer was then heated in air at 400° C. Ruthenium was then applied to the surface in the form of a solution of ruthenium chloride which was stoved to produce ruthenium oxide. Alternatively, platinum-iridium may be applied if required.

EXAMPLE 12

A titanium sample was degreased, etched, washed and prepared as set out in Example 1. The sample was inserted into a 7wt% sulphuric acid solution containing 5g/l of titanium as $Ti^{3+}$ ions. The sample was supplied with a positive potential with respect to a lead cathode to give an anode current density of about 60 amps/m$^2$. The solution was heated to and maintained at 90° C. After 15g of titanium dioxide had been applied, the sample was removed, dried and heated in air for 30 minutes at 500° C. A further layer of titanium dioxide was then applied from the acidic titanium cation-containing solution and the second titanium oxide layer was then heated in air at 400° C.

A paint solution containing ruthenium chloride and n-butyl titanate in isopropyl alcohol was prepared. The proportions of the ruthenium chloride and n-butyl titanate are so chosen that of the metals present, 80wt% is ruthenium, and 20wt% is titanium. This paint was then applied to the surface of the titanium oxide in four coats, each coat being absorbed into the titanium dioxide before the next coat was applied. After the four coats of paint had been applied, the layer was heated in air at 500° C for 30 minutes to convert the ruthenium chloride to ruthenium oxide and to convert the n-butyl titanate to titanium dioxide.

Alternatively, a platinum-iridium mixture may be used in place of the ruthenium chloride to form a platinum-iridium electrocatalytic layer in the eventual product.

EXAMPLE 13

A titanium specimen in the form of 3mm wires was degreased and etched in sulphuric acid. After washing in cold water, the sample was immersed in boiling demineralised water for 1 hour. When dry, the sample was inserted into a solution containing $Ti^{3+40}$ ions and 7wt% sulphuric acid. The solution was maintained at a temperature of 90° C and the sample was connected as an anode and left in the solution to form an initial electrocoat deposit of 10g/m². The sample was removed, washed and dried in air at ambient temperature. The sample was heated in air to 450° C for 1 hour and after cooling was reinserted in the solution to deposit an outer coating of 10g/m² of electrocoat. This second layer was then washed, dried and heated in air at 450° C for 1 hour.

The pre-treated surface was coated with ruthenium dioxide using a 40g/l strength of paint (in terms of ruthenium content in a butanol solvent) and fired at 500° C in air for 20 minutes. The process was repeated until a total loading of 10g/m² of ruthenium was applied. The anode was operated in a mercury cell at a cathode plan current density of 10kA/m² for greater than 1 year with a low overpotential. Metallographic and electron probe X-ray micro-analysis revealed that the double electrocoat structure was intact at the end of the year with low wear.

EXAMPLE 14

Mesh-type titanium electrodes measuring 18 433 24 were prepared and coated as in Example 13. The anodes were mounted in the form of a box-type diaphragm cell and the anodes were mounted in plant scale diaphragm cells and were observed to operate satisfactorily at acceptable cell voltages over many months at 2kA/m² cathode plan current density.

EXAMPLE 15

Sheet titanium anodes of the size 12 × 18 were prepared as in Example 13 and were found suitable for installation in chlorate electrolysis cells. A minor change was made in the heat treatment temperature for stoving of the ruthenium paint such that it was limited to 400° C in air. The coating was applied by electrostatic spraying using a paint consisting of ruthenium trichloride dissolved in pentanol. Decreasing concentrations of paint were used and a number of paint/stove applications were made. The final thicknesses of the various layers were 8g/m² for the first electrocoat, 12g/m² for the outer electrooat, and 8g/m² ruthenium as ruthenium dioxide. For some electrodes, it was found preferable to give a post heat treatment in air of up to 12 hours at 500° C. Such surfaces were operated in circulating loop-type sodium chlorate electrolysis cells with chlorate in the concentration 550g/l, sodium chloride 100g/l and sodium dichromate 2g/l at 50° C. Measurements showed that the oxygen evolved over many months of operation was less than 2%.

It will be appreciated that a large number of coats may be applied to the electrode if required and although only four coats of one type have been described as a maximum in any of the examples referred to above, this is not intended to be limiting and a greater number may be applied if required.

An anode manufactured according to Example 1 was utilised in an electrolytic cell for a period of time until the ruthenium oxide has become exhausted. The anode was then removed, dried and degreased. The degreased anode was washed in a 10wt% nitric acid aqueous solution at ambient temperature to remove calcerious matter deposited on the anode surface. The anode was then further washed in cold water and dried. A further layer of ruthenium oxide was then applied to the surface by painting the surface with a ruthenium chloride based paint. The surface was dried and a further layer of ruthenium chloride based paint applied to it. This process was continued until approximately 15g/m² of ruthenium had been applied, whereupon the surface was stoved in air for 2 hours to convert the ruthenium chloride to ruthenium oxide and to reform a working anode. If required, a further electrocoat may be applied to the degreased, acid cleaned, washed and dried electrode before the ruthenium is applied to it.

It has been found possible to vary the porosity of the two layers of electrocoat by varying the ratio of the thickness of the first to the second layer. If a mainly porous layer is required, a thin first layer of electrocoat is applied, heated and thicker second layer is applied to it. This second layer has a porous nature which can absorb relatively large quantities of ruthenium. If, however, a more dense layer is required, a first relatively thick electrocoated layer is applied, and a second thin layer is then applied after heating the first layer. This second layer mainly fills some of the pores in the first layer and produces a relatively dense electrocoat.

It will be appreciated that the electrically conducting layer may be any suitable material, for example ruthenium paint may be applied and may be fired at a temperature in the range 400° to 500° C, optionally with post heat treatments such as reducing treatments.

Any of the Examples may be modified to incorporate a conducting primer coating such as a primer layer of pure platinum, 70:30 platinum-iridium or ruthenium or ruthenium oxide. The primer layer may be applied by painting a suitable precious metal containing paint onto the substrate surface and firing to produce the primer layer.

I claim:

1. A method of manufacturing an electrode suitable for use in electrolytic processes which comprises the steps of inserting into a solution containing cations of titanium a body having at least its surface selected from the group consisting essentially of a film-forming metal, nickel, or lead, connecting the body as an anode and depositing on the surface a layer of an oxide of titanium, removing the body from the solution and heating the layer to a temperature greater than 100° C but less than 800° C, reinserting the body in a solution containing cations of titanium, connecting the body as an anode and depositing a further layer of an oxide of titanium on the surface and applying to the surface an electrically conductive electrolyte-resistant and electrolysis product resistant layer containing a metal of the platinum group or an oxide of a metal of the platinum group.

2. A method as claimed in claim 1 including applying to the electrically conductive layer a layer of a film-forming metal oxide.

3. A method as claimed in claim 2 in which the layer of a film-forming metal oxide is tantalum oxide.

4. A method as claimed in claim 3 in which the tantalum oxide layer is applied by coating a solution of a compound containing tantalum in a suitable solvent followed by heating the surface to oxidise the compound to tantalum oxide.

5. A method as claimed in claim 1 in which there is provided a primer coating on the starting surface of the film-forming metal.

6. A method as claimed in claim 5 in which the primer coating includes particulate fibrous zirconium oxide.

7. A method as claimed in claim 6 in which the particulate material is fibrous zirconium oxide.

8. A method as claimed in claim 5 in which the primer coating contains a precious metal or a precious metal oxide.

9. A method as claimed in claim 1 in which the heating step occurs in an oxidising atmosphere.

10. A method as claimed in claim 9 in which the heating step occurs in air.

11. A method as claimed in claim 1 in which the electrically conductive layer is provided by applying a solution of a platinum group metal compound in a solvent onto the surface of the oxide layer and heating the compound to form the platinum group metal or oxide.

12. A method as claimed in claim 11 in which the solution contains a compound of a film-forming metal.

13. A method as claimed in claim 11 in which the platinum metal compound is a ruthenium compound.

14. A method as claimed in claim 1 in which, after any of the previous layers is applied, there is applied a layer comprising a dispersion of small particles of titanium dioxide having a particle size in the range 0.01–10 microns in a carrier medium, the layer being heated to drive off the carrier medium for the dispersion and to leave a fine layer of small titanium dioxide particles.

15. A method as claimed in claim 14 in which the carrier medium is an acrylic copolymer.

16. A method as claimed in claim 1 in which, before any of the previous layers is applied, there is applied a layer comprising a dispersion of small particles of titanium dioxide having a particle size in the range .01 to 10 microns in a carrier medium, the layer being heated to drive off the carrier medium for the dispersion and to leave a fine layer of small titanium dioxide particles.

17. A method as in claim 16 in which the carrier medium is an acrylic copolymer.

18. A method as claimed in claim 1 in which the temperature range is 350° to 550° C.

19. A method as claimed in claim 1 in which the electrically conductive layer is applied between the layers of oxide.

20. A method as claimed in claim 1 in which there are three or more oxide layers deposited on the surface and the electrically conductive layer is provided between any or all pairs of oxide layers or is applied to the outer oxide layer only.

* * * * *